United States Patent [19]

Rogers

[11] Patent Number: 4,534,130

[45] Date of Patent: Aug. 13, 1985

[54] FLOWER TOTE

[76] Inventor: William S. Rogers, 3393 Sewell Mill Rd., Marietta, Ga. 30062

[21] Appl. No.: 428,058

[22] Filed: Sep. 29, 1982

[51] Int. Cl.[3] ..... A01G 9/02

[52] U.S. Cl. ..... 47/66; 47/67; 47/68

[58] Field of Search ..... 47/66, 67, 39, 40, 68, 47/78; 220/17, 95; 294/142, 19.2; 16/18 R; 108/131, 132; 248/180.91

[56] References Cited

U.S. PATENT DOCUMENTS

| | | | |
|---|---|---|---|
| 1,084,414 | 1/1914 | Eger | 47/68 |
| 2,075,354 | 3/1937 | Monier | 108/131 |
| 2,423,724 | 7/1947 | Paxton | 47/86 |
| 2,676,709 | 4/1954 | Walsh | 294/142 |
| 2,802,296 | 8/1957 | Abbott | 294/142 |
| 3,776,410 | 12/1973 | Carlson | 220/19 |
| 3,879,798 | 4/1975 | Krulwich | 16/18 R |
| 4,046,261 | 9/1977 | Yake | 220/19 |
| 4,058,233 | 11/1977 | Frangos | 220/19 |
| 4,412,697 | 11/1983 | Verde | 294/19.2 |

*Primary Examiner*—Robert E. Bagwill
*Assistant Examiner*—Bradley M. Lewis
*Attorney, Agent, or Firm*—Schwartz, Jeffery, Schwaab, Mack, Blumenthal & Evans

[57] ABSTRACT

A wire mesh basket is disclosed which features a convertible, removable handle arrangement for permitting the basket to be used either as a tote for potted plants, floral arrangements or the like or as a display stand. For displaying or toting heavy loads a carriage bottom is described, and for stacking several baskets a foldable wire mesh cover is disclosed. The basket may be used as a planter with an appropriate plastic or ceramic liner or as a window box with the use of window sill hooks.

10 Claims, 7 Drawing Figures

FLOWER TOTE

BACKGROUND OF THE INVENTION

1. Field of the Invention

The present invention relates to a device for the transportation and display of various items, and more particularly relating to the transportation, display and care of potted plants, flowers or the like.

The present invention also relates to a container fitted with removable handle means that are also convertible into a pedestal or stand means.

2. Background and Prior Art

The use of potted plants or floral arrangements is widespread among family residences, apartments, offices and commercial buildings as well as among specialized organizations such as churches, hospitals and funeral establishments. In the home environment particularly, it is not uncommon to have many plants of various sizes and varieties located throughout the home.

Providing plants with the proper amount of sunlight is essential for proper care and growth. This may require moving plants from one room to another or out of doors to catch sufficient sunlight at different times of the year. This can be a time consuming and difficult task, particularly when a display must be repeatedly moved between several locations.

Transporting a clay pot and its associated saucer is usually a tedious "one-at-a-time" job even for small size pots and, for the larger sizes, may become a difficult task due to the weight involved. Display devices presently available to hold or contain potted plants consist primarily of woven wooden baskets or various types of tables, shelving, stools and racks not necessarily designed for the specific purpose of displaying or storing plants, or metal stands, some with flourescent light fixtures and some which contain shallow trays to hold several small pots. With the exception of some of the shelving and metal stands, these devices are usually capable of holding only one or maybe two plants. Repair or disposal is often required for these devices due, for instance, to the cracking of the wooden baskets or the paint peeling from or the rusting of the metal stands. Many plants are displayed without using any holding or storage device at all, usually on a flat surface such as a window sill or directly on the floor. This often times results in damage to the surface due to moisture or spillage or pottery stains.

A planting container of woven wire mesh, adapted to be embedded in the ground to protect plant roots and to facilitate transplanting is disclosed in U.S. Pat. No. 1,689,017.

Display and storage devices which utilize wire mesh construction are disclosed in U.S. Pat. Nos. 4,180,277 and 1,648,025.

Wire mesh baskets or containers having handles or means to suspend the baskets are generally disclosed in the following U.S. Patent references:

4,149,663 Agar
2,812,875 Buzicky et al
2,635,779 Pfeiffer
2,458,246 Brereton
1,865,533 Lutzke
1,646,716 Wheeler
809,658 Hurlburt
348,988 Miller.

Prior art collapsible or adjustable stands or supports are generally disclosed in the following U.S. Patent references:

3,608,600 Lehrman
3,595,509 Gilmore
2,724,571 Friedman et al
967,471 Wanamaker
686,006 McConnell.

A wire mesh kitchen utensil which can be converted to perform a plurality of domestic functions and which has handles that can be converted to form a stand is disclosed in U.S. Pat. No. Re. 24,581 to Escaut.

None of these devices, however, are suitable for use as a tote or display device for potted plants or the like as explained above, nor do any teach or suggest the advantageous of the removable and convertible tote handles and display stand of the present invention.

SUMMARY OF THE INVENTION

Accordingly, it is an object of the present invention to provide a convenient and useful device to transport and/or display items such as potted plants, floral arrangements, merchandise or the like.

It is a further object of the present invention to provide a device for transporting and/or displaying a multiplicity of plants, each in an individual container such as a clay pot or vase, without the need to remove the containers from the display unit.

A still further object of the present invention is to provide a display or transport device which prevents contact between a potted plant, floral arrangement or the like and surfaces such as carpets, window sills or finished floors, thereby reducing the potential for damage to those surfaces.

A still further object of the present invention is to provide a device which is flexible with regard to the possible methods of transport and display of various items and which is adaptable to optional attachments.

In accordance with the present invention a basket for carrying and displaying items such as, for example, potted plants and flowers is provided. The basket comprises a wire mesh, provided with a protective cover of plastic or the like and further comprises clasps, positioned on opposite sides of the basket, having spring clips or the like which grip a pair of convertible handles. Each of the handles has a first end which is gripped by the spring clips, preferably in such a manner that the handles can rotate, and a second end. A pair of second ends cooperate to form either a tote handle or a pair of supports for using the basket as a display stand.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated and form a part of the specification, illustrate various embodiments of the present invention and, together with the description, serve to explain the principles of the present invention. Corresponding elements are similarly numbered in the various drawings. In the drawings.

DETAILED DESCRIPTION OF THE INVENTION

The basket of the present invention, together with its associated handles, clasps and accessories will hereinafter be referred to as a flower tote.

The flower tote is a device for the transport, display and care of single or multiple potted plants or other types of flower arrangements. The basic unit consists of a wire-molded basket (FIGS. 1 and 2) with a pair of handles 30 (FIG. 3).

Figure 1:
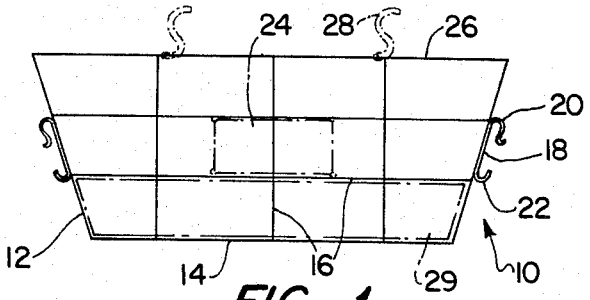
FIG. 1 is a side view of a plant basket type device in accordance with the present invention.
Figure 2:
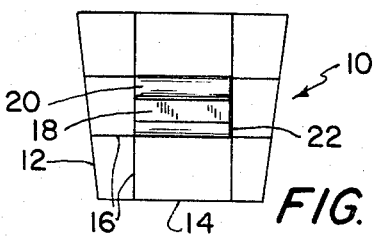
FIG. 2 is an end view of the plant basket of FIG. 1.
Figure 4A:
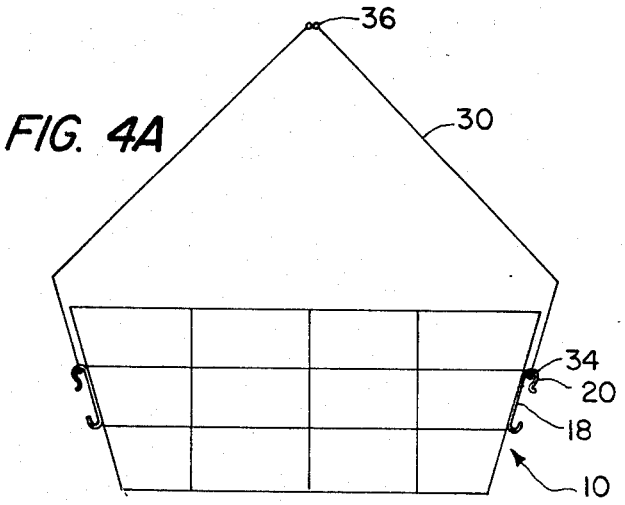
FIGS. 4A and 4B are front views of the basket device with, respectively, the handles in the "up" position for transportation or hanging of the basket and in the "down" position to provide a stand for the basket.
Figure 4B:
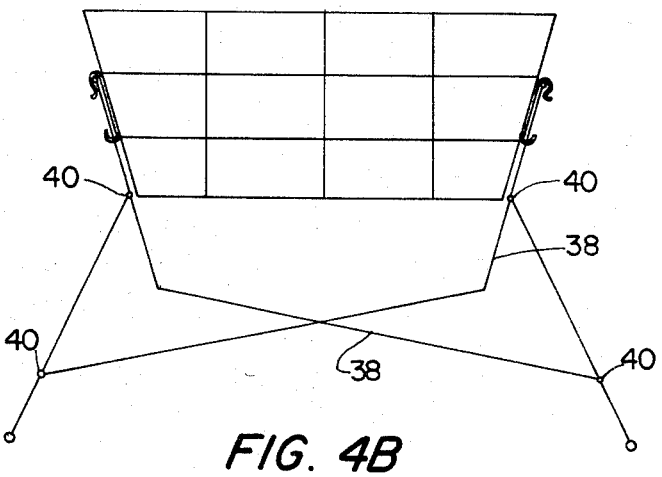
Figure 6:
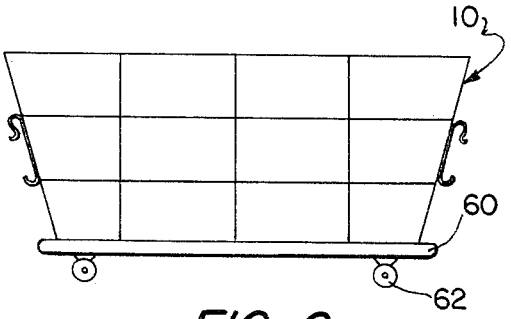
FIG. 6 is a side view of a basket in accordance with the present invention equipped with a caster bottom.

Turning first to FIGS. 1 and 2 and to the basket depicted therein. The basket, as illustrated in FIGS. 1 and 2, is a wire basket having a welded wire frame 12, 14, with a plurality of interlaced wires 16, all of which cooperate to form a basket. The various wires which form the basket may be fitted with clear or colored washable plastic molding to fit the wire. The plastic or other protective coating for the wires forms a moisture barrier to prevent rust or deterioration of the basket and to maintain its attractive appearance. The basket is fitted on each end with a permanent handle clasp 18 which allows the handles 30 to be easily removed from or attached to the basket. The clasps 18 have a portion 20 which engages the handles 30 by means of a spring clip type action. As best seen in FIGS. 4A and 4B, the handles, once inserted into the clip portion 20 of the clasp 18, will be retained until the user desires to remove the handles to display the basket in some other way, i.e., as a window box or on a caster platform (FIG. 6). The clasps 18 may also be provided with decorative scroll portions 22 to enhance the appearance of the flower tote. Preferably, a name plate 24 for identifying the plant variety or floral contents, owner of the tote, or the like may be provided.

Figure 3:
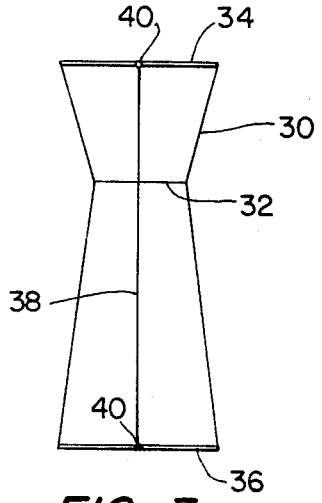
FIG. 3 is a first view of a handle device in accordance with the present invention.

Turning now to FIG. 3 wherein the handle means are depicted. The handles 30 are preferably made of similar materials as the basket, i.e., plastic coated wire (FIG. 3) and, as explained hereinbelow, provides the means for carrying or hanging the basket (FIG. 4A) and for displaying the plants above the floor surface (FIG. 4B). An end 34 of each handle 30 is designed to fit the spring clip portion of the handle clasps 18. Another end 36 is equipped with a rubberized cover or the like for ease in carrying and for providing resistance to slippage when the handles are used as legs and that end is in contact with a floor or support surface.

A lateral brace rod 32 is preferably provided on each handle to provide support and rigidity. The brace 32 may be permanently attached to the handle. A longitudinal bracing rod 38 is also provided with spring clips or other similar removable connectors 40 at each end. This rod, when the handle is used for hanging or carrying, as in FIG. 4A, serves as a stabilizing connector rod between handle ends 34 and 36.

When the handle 30 is used to form legs for positioning the basket 10 above a surface, the rods 38 are used to attach the opposite legs to each other to prevent them from spreading apart. In this position the rods 38 may be attached to the handles at the brace 32, along the wire 30 or at any other convenient location. The length of the handles may vary according to the desired display purpose. For instance, if a floral arrangement is to be displayed at a wedding or the like, long handle legs may be used to allow the basket to be raised high.

As will be apparent to the artisan, the design of the basket, together with the handles, permits a user with limited strength (or a back problem) to convert the device from the carrying mode (FIG. 4A) to the display mode (FIG. 4B) without stooping or bending.

Figure 5:
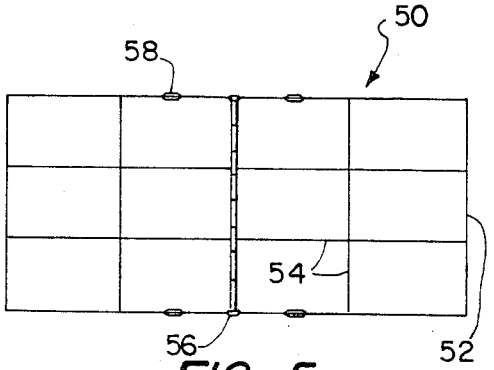
FIG. 5 is a top view of a hinged top adapted to fit the basket of FIGS. 1 and 2.

As best seen in FIG. 5, a hinged top 50 may be provided to fit over the basket 10 to allow for shipping plants in the basket or for stacking baskets with plants in them. The cover is preferably made of plastic coated wires of similar construction to the basket 10. The cover is preferably provided with a hinge member 56 to allow the cover to be folded back thus providing access to the interior of the basket. A plurality of spring clips 58 or other removable fastening means are provided to allow the cover 50 to be removably attached to the basket 10.

If the basket and its contents are moved frequently or if the contents are heavy, a carriage 60 (FIG. 6) equipped with a plurality of casters 62 may be provided. In this manner, the basket may be pushed or pulled rather than being lifted and carried.

For use as a window box, the basket may be attached to the interior or exterior of a window by the use of hooks 28 (FIG. 1) which capture the top wire 26 of the basket 10 and which are appropriately shaped to engage the sill of a window for supporting the basket. A pan 29 (FIG. 1) may be provided to fit within the basket to allow for the planting of bulbs or seeds or the like without the need for individual flower pots. This feature is especially desirable when the tote is used as a window box.

A tote, constructed in accordance with the present invention, will provide a device of quality construction, without moving parts and which allows easy attachment of the various accessories (i.e., name plates, carriages, sill hooks, etc.) and easy transformation between its various arrangements (i.e., carrying or display mode) and which will remain attractive and durable under normal use with maintenance limited to routine cleaning as required.

While the tote has been disclosed for use as a plant or flower carrying and display device, it should be appreciated that it can easily be adapted to carry or display any sort of merchandise desired. For some applications a finer screen basket may be provided or a basket specifically adopted to complement particular merchandise may be provided.

The foregoing description of the preferred embodiments of the invention have been presented for purposes of illustration and description. They are not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A basket for carrying and displaying, comprising:

(a) a plurality of intermeshed wires forming a bottom and sides of said basket;

(b) at least two spring clips disposed on opposing sides of said basket, each of said spring clips comprising a downwardly opening spring member;

(c) at least two handles, each having a first end adapted to be resiliently engaged by and freely removable from a respective one of said spring clips in a first and a second stable position, and a second end, said second end serving as a tote handle when disposed above said basket in said first stable position and as a stand to support said bastet when in said second stable position, each of said handles being rotatable, when engaged in its respective spring clip, between said first and second positions;

(d) means for restraining said handles when in said second stable position for preventing said handles from rotating towards said first stable position; and (e) wherein said handles are generally in the form of a trapezoid and further comprise a stabilizing bar; said bar being connected between said first and second ends when said handles are in said first position and being interconnected between said handles when said handles are in said second position, whereby said handles are prevented from spreading apart in said second position.

2. The basket of claim 1, wherein said first end comprises a first generally bar-like member, and said spring clip engages said bar-like member generally parallel to an axis thereof thereby permitting said first member to rotate.

3. The basket of claim 1, further comprising sill hooks for hanging said basket from a window.

4. The basket of claim 1, further comprising indicia means for carrying identifying material regarding said basket.

5. The basket of claim 1, further comprising a foldable wire mesh cover adapted to fit over said basket, said cover including a transverse hinge for permitting a portion of said cover to be folded back.

6. The basket of claim 1, further comprising a carriage means having casters thereon and positioned under the basket for facilitating the transport of heavy loads.

7. The basket of claim 1, further comprising an insert adapted to fit inside of said basket for permitting the planting of plants directly in said basket.

8. The basket of claim 1, wherein said wires are covered.

9. The basket of claim 8, wherein said covering is a plastic coating.

10. A basket for carrying and displaying, comprising:

(a) a plurality of intermeshed wires forming a bottom and sides of said basket;

(b) at least two spring clips disposed on opposing sides of said basket, each of said spring clips comprising a downwardly opening spring member;

(c) at least two handles, each having a first end adapted to be resiliently engaged by and freely removeable from a respective one of said spring clips in a first and a second stable position, and a second end, said second end serving a tote handle when disposed above said basket in said first stable position and as a stand to support said basket when in said second stable position each of said handles being rotatable, when engaged in its respective spring clip, between said first and second positions;

(d) means for restraining said handles when in said second stable position for preventing said handles from rotating towards said first stable position;

(e) said second end comprising a second generally bar-like member having a rubber-like cover for facilitating its use as a tote handle in said first position and for providing resistance to slippage in said second position; and (f) said handles are generally in the form of a trapezoid and further comprising a stabilizing bar; said bar being connected between said first and second ends when said handles are in said first position and being interconnected between said handles when said handles are in said second position, whereby said handles are prevented from spreading apart in said second position.

* * * * *